US010436101B2

(12) United States Patent
Ichihara et al.

(10) Patent No.: US 10,436,101 B2
(45) Date of Patent: Oct. 8, 2019

(54) COOLING CONTROL DEVICE AND COOLING CONTROL METHOD FOR INTERNAL COMBUSTION ENGINE

(71) Applicants: Nissan Motor Co., Ltd., Kanagawa (JP); Valeo Systemes Thermiques, Le Mesnil Saint Denis (FR)

(72) Inventors: Takayoshi Ichihara, Kanagawa (JP); Stephane Peyrazat, Cergy Pontoise (FR)

(73) Assignees: Nissan Motor Co., Ltd., Kanagawa (JP); Valeo Systemes Thermiques, Le Mesnil-Saint-Denis (FR)

( * ) Notice: Subject to any disclaimer, the term of this patent is extended or adjusted under 35 U.S.C. 154(b) by 1041 days.

(21) Appl. No.: 14/401,200

(22) PCT Filed: May 14, 2013

(86) PCT No.: PCT/JP2013/003068
§ 371 (c)(1),
(2) Date: Nov. 14, 2014

(87) PCT Pub. No.: WO2013/172017
PCT Pub. Date: Nov. 21, 2013

(65) Prior Publication Data

US 2015/0267603 A1 Sep. 24, 2015

(30) Foreign Application Priority Data

May 14, 2012 (JP) ..... 2012-110525

(51) Int. Cl.
*F01P 7/16* (2006.01)
*F01P 11/16* (2006.01)

(52) U.S. Cl.
CPC ..... *F01P 7/165* (2013.01); *F01P 7/167* (2013.01); *F01P 11/16* (2013.01); *F01P 2031/32* (2013.01)

(58) Field of Classification Search
CPC ..... F01P 11/16; F01P 2031/32; F01P 7/165; F01P 7/167; F01P 2007/146; F16K 11/0856; F16K 31/002
(Continued)

(56) References Cited

U.S. PATENT DOCUMENTS 3,768,731 A * 10/1973 Lavado ..... G05D 23/022 236/101 B
3,851,629 A * 12/1974 Mayr ..... F01P 7/16 123/41.02
(Continued)

FOREIGN PATENT DOCUMENTS

JP 2003-138939 A 5/2003
JP 2003138939 A * 5/2003
(Continued)

OTHER PUBLICATIONS

Tanaka, Cooling Water Structure of Engine, May 14, 2003, JP2003138939A, Whole Document.*
(Continued)

*Primary Examiner* — Larry L Furdge
(74) *Attorney, Agent, or Firm* — Osha Liang LLP

(57) ABSTRACT

A cooling control device for an internal combustion engine has an internal coolant passage formed in the internal combustion engine, external coolant passages formed outside the internal combustion engine and connected to the internal coolant passage, the cooling control device performing coolant passage switching in which the internal coolant passage and a certain one of the external coolant passages are connected to or disconnected from each other by a circuit
(Continued)

switching mechanism, a branching passage that sends coolant in the internal coolant passage to one of the external coolant passages which passes through a radiator, when the circuit switching mechanism has a failure and fails in circuit switching of connecting the internal coolant passage and the external coolant passage passing through the radiator to each other, and a wax-type thermostat provided in the branching passage that opens the branching passage when the internal combustion engine is excessively heated.

3 Claims, 7 Drawing Sheets

(58) Field of Classification Search
USPC ..... 236/34.5; 123/41.09, 41.1
See application file for complete search history.

(56) References Cited

U.S. PATENT DOCUMENTS 4,346,837 A * 8/1982 Inagaki ..... G05D 23/021 236/100
4,560,104 A * 12/1985 Nagumo ..... F01P 7/167 236/34.5
4,748,941 A * 6/1988 Kashiwase ..... F01P 7/16 123/41.1
5,593,088 A * 1/1997 Hennrich ..... B60H 1/00485 236/100
5,711,258 A * 1/1998 Saur ..... F01P 7/167 123/41.29
5,894,834 A * 4/1999 Kim ..... F01N 5/02 123/41.29
5,979,373 A * 11/1999 Sano ..... F01P 7/167 123/41.08
6,283,381 B1 * 9/2001 Uchiyama ..... F01P 11/16 123/41.15
6,450,410 B1 * 9/2002 Song ..... F01P 3/02 236/34.5
7,987,822 B2 8/2011 Fishman et al.
8,042,499 B2 * 10/2011 Lee ..... F01P 7/165 123/41.02
8,220,421 B2 * 7/2012 Utsuno ..... F01N 5/02 123/41.08
8,430,071 B2 * 4/2013 Carlson ..... F01P 5/12 123/41.1
8,701,603 B2 4/2014 Warnery et al.
9,309,802 B2 4/2016 Warnery et al.
2002/0189555 A1 * 12/2002 Murakami ..... F01P 3/20 123/41.1
2004/0187805 A1 * 9/2004 Arisawa ..... F01P 7/162 123/41.14
2010/0095908 A1 * 4/2010 Deivasigamani .... G05D 23/134 123/41.1
2010/0212612 A1 * 8/2010 Vacca ..... F01P 7/165 123/41.09
2012/0168138 A1 * 7/2012 Myers ..... F02B 29/0475 165/200
2012/0279462 A1 11/2012 Warnery et al.
2013/0167784 A1 * 7/2013 Quix ..... F02M 25/0738 123/41.1
2014/0224361 A1 8/2014 Warnery et al.
2015/0275742 A1 * 10/2015 Chekaiban ..... F01P 3/20 123/41.08

FOREIGN PATENT DOCUMENTS

JP 3794783 B2 4/2006
JP 2010-528229 A 8/2010
JP 2012-26341 A 2/2012
WO 2011/086154 A1 7/2011

OTHER PUBLICATIONS

International Search Report for corresponding International Application No. PCT/JP2013/003068, dated Jun. 25, 2013 (3 pages).
Written Opinion for corresponding International Application No. PCT/JP2013/003068, dated Jun. 25, 2013 (4 pages).
International Preliminary Report on Patentability for corresponding International Application No. PCT/JP2013/003068, dated Mar. 27, 2014 (7 pages).

* cited by examiner

[Fig. 1]
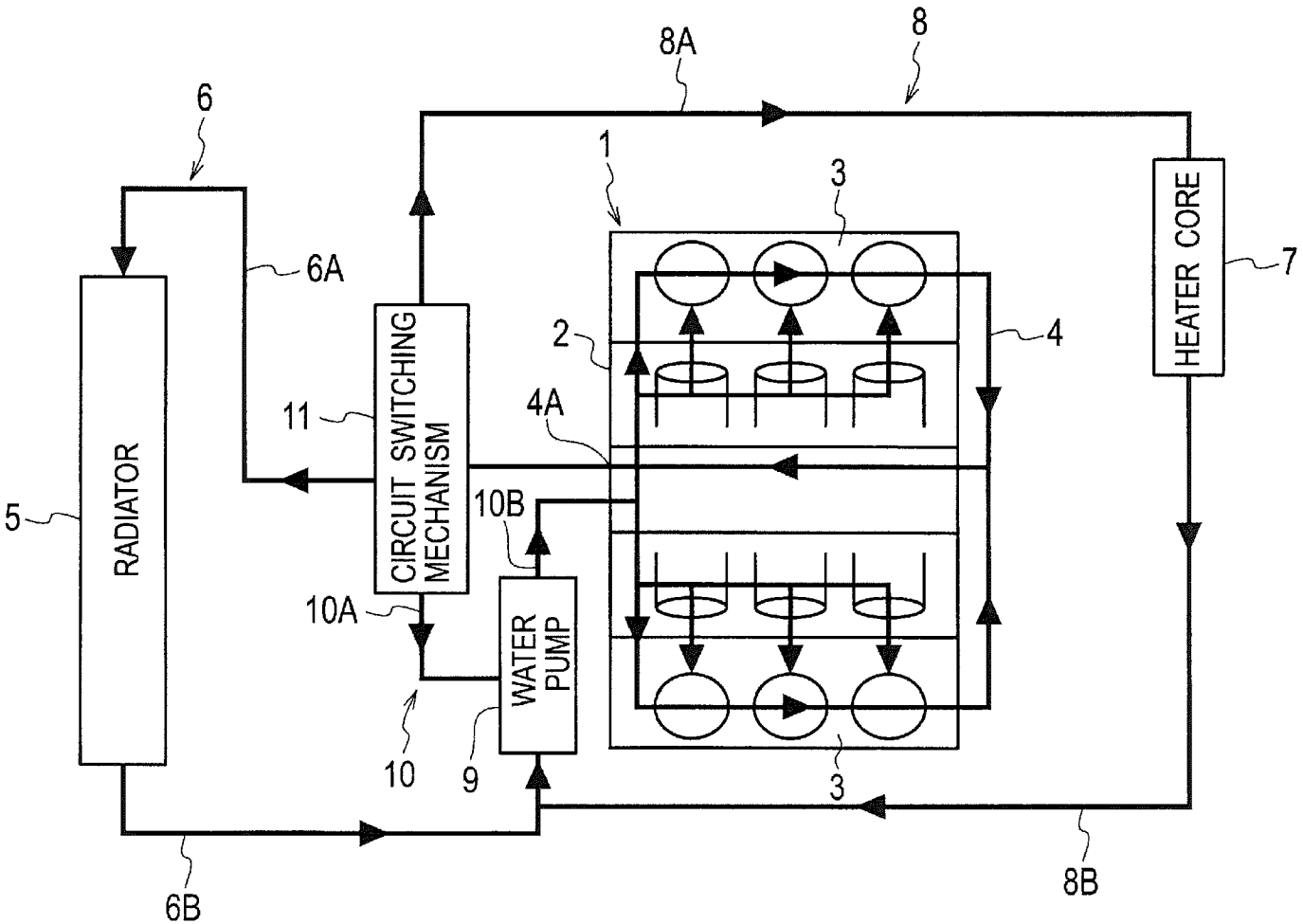

[Fig. 2]
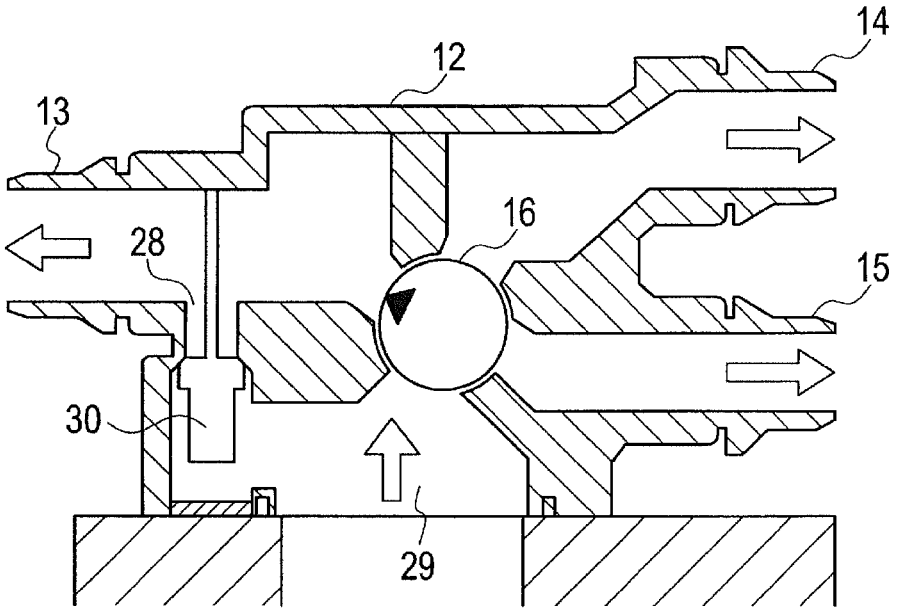

[Fig. 3]
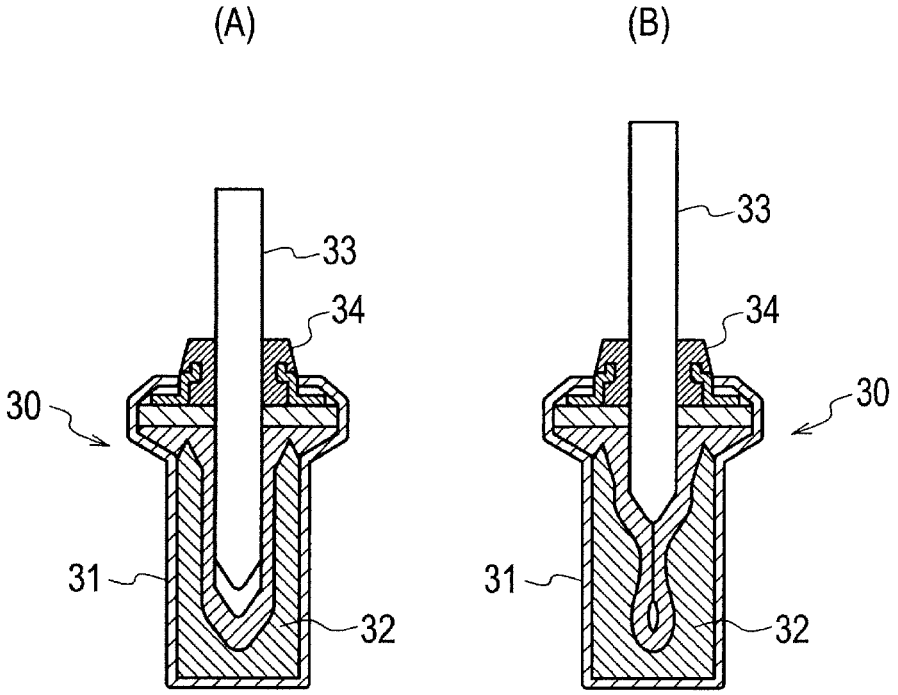

[Fig. 4]
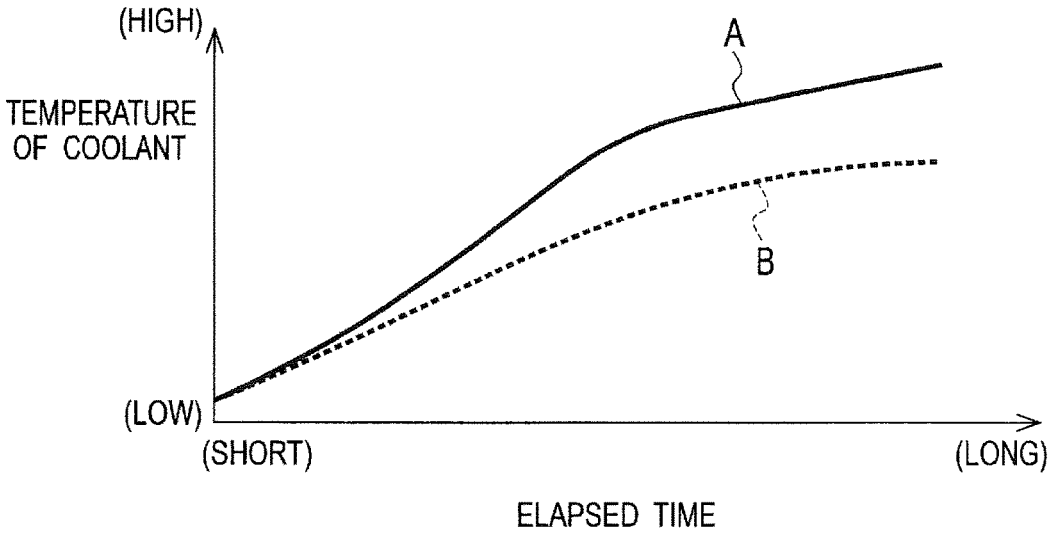

[Fig. 5]
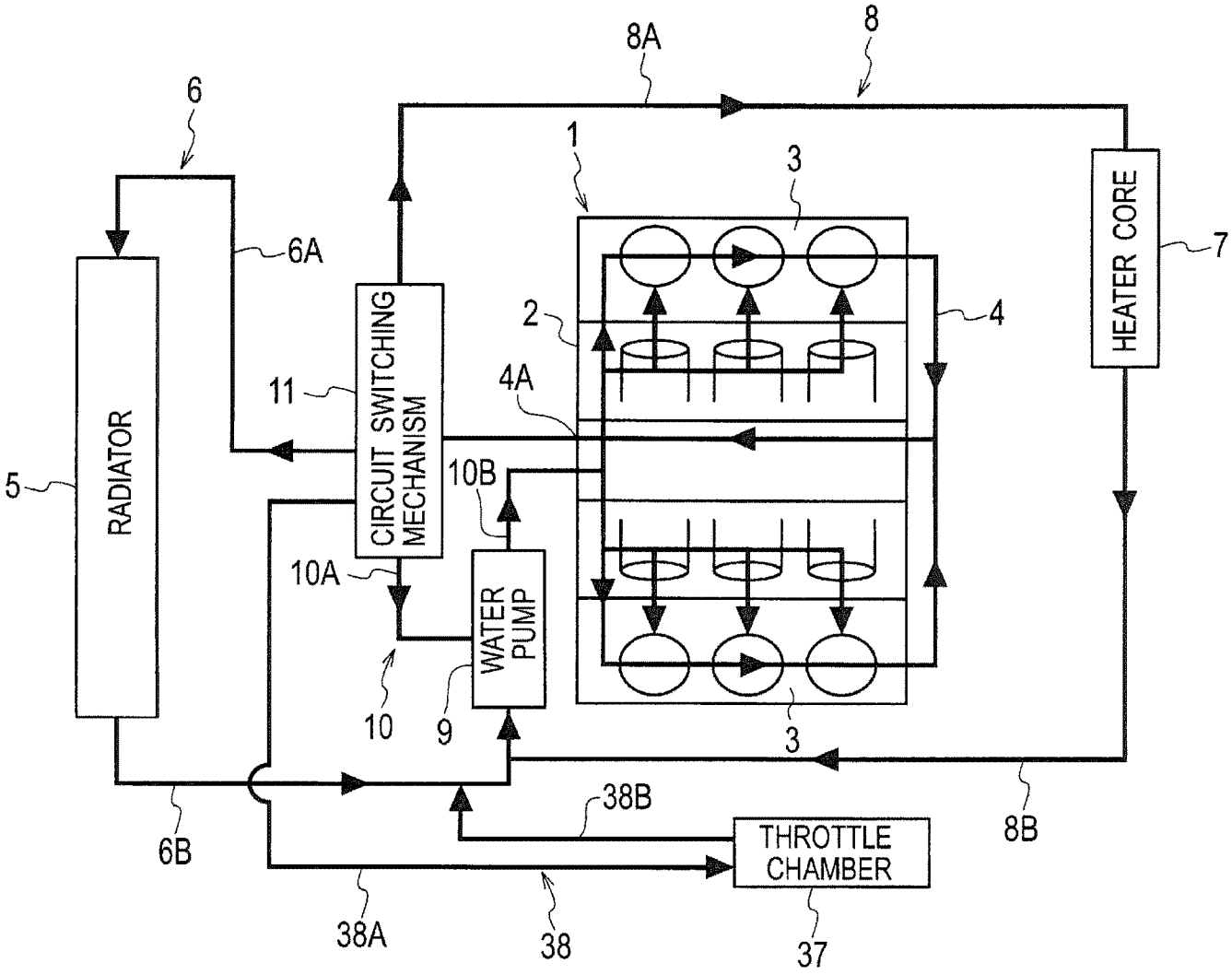

[Fig. 6]
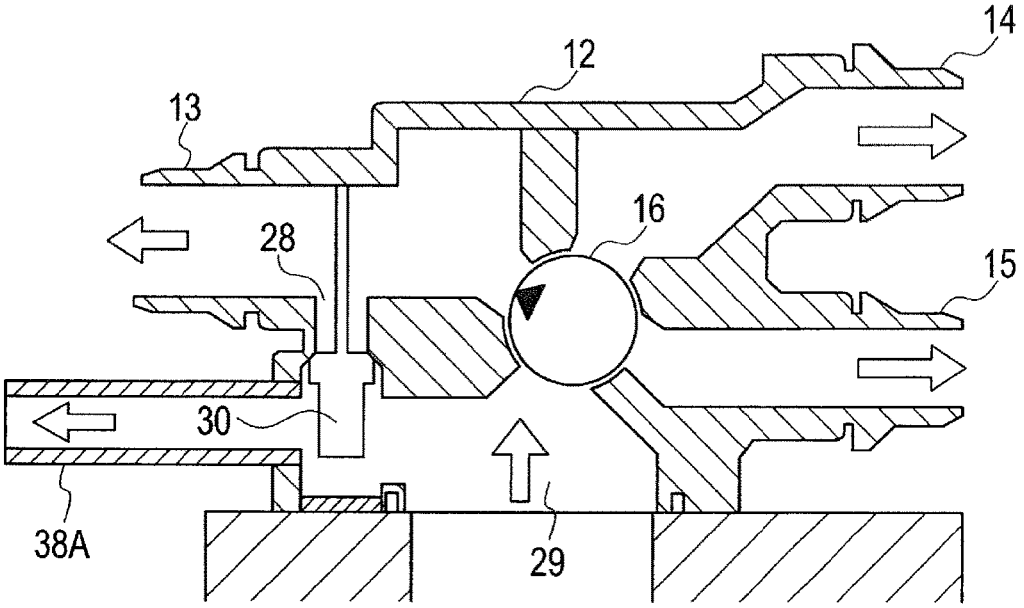

[Fig. 7]
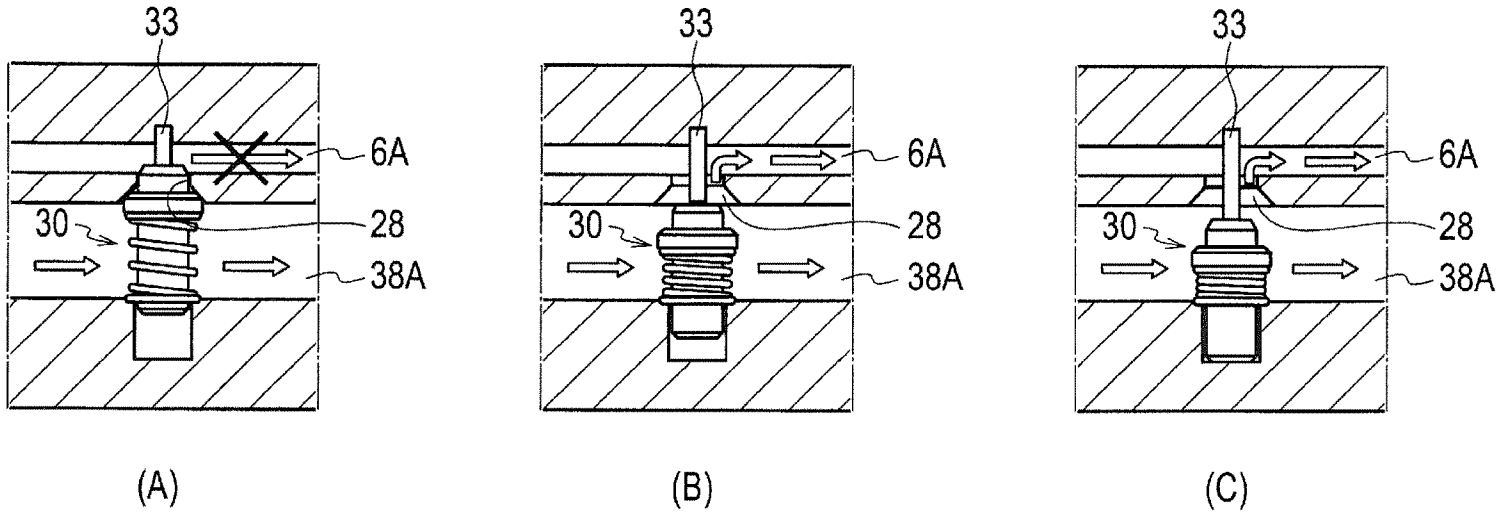

COOLING CONTROL DEVICE AND COOLING CONTROL METHOD FOR INTERNAL COMBUSTION ENGINE

CROSS-REFERENCE TO RELATED APPLICATIONS

This application claims the benefit of priority from Japanese Patent Application No. 2012-110525 filed on May 14, 2012, the entire contents of which are incorporated by reference in the present application.

BACKGROUND

Technical Field

The present invention relates to a cooling control device and a cooling control method for cooling an internal combustion engine such as a car engine.

Related Art

When a cooling control device for cooling an internal combustion engine such as a car engine has a failure in a control system configured to control the flow of coolant, the internal combustion engine (engine) overheats.

As a technique of preventing such overheat of the internal combustion engine, Japanese Patent No. 3794783 discloses a technique of releasing connection of a control drive valve between a motor and a flow passage control valve by using a clutch mechanism when an abnormal temperature of coolant in the internal combustion engine is detected. This technique prevents the engine from overheating by forcibly opening the flow passage control valve to promote the circulation of the coolant.

SUMMARY

However, when a clutch control circuit fails during the failure of the motor, the flow passage control valve cannot be forcibly opened but is fixed in a closed state. As a result, no coolant flows to a radiator and the engine overheats.

Moreover, since the clutch control circuit and the clutch mechanism are necessary, the number of parts is large and this leads to an increase in cost.

One or more embodiments of the present invention is to provides a cooling control device and a cooling control method for an internal combustion engine which, when circuit switching fails in connecting an internal coolant passage in the internal combustion engine and an external coolant passage passing through the radiator to each other, can send the coolant inside the internal coolant passage to the radiator, and which has no increase in the number of parts, nor cost increase accordingly.

A cooling control device of an internal combustion engine according to one or more embodiments of the present invention is provided with: a branching passage configured to send coolant in an internal coolant passage to one of external coolant passages which passes through a radiator, when circuit switching means has a failure and fails in circuit switching of connecting the internal coolant passage and the external coolant passage passing through the radiator to each other; and a wax-type thermostat provided in the branching passage and configured to open the branching passage when the internal combustion engine is excessively heated. In the cooling control device, a temperature sensing portion of the wax-type thermostat is provided near an inlet of an external coolant passage configured to send the coolant in the internal coolant passage to a throttle chamber.

BRIEF DESCRIPTION OF DRAWINGS

FIG. 1 is a cooling circuit diagram of an internal combustion engine according to one or more embodiments of the present invention.

FIG. 2 is a cross-sectional view of a circuit switching mechanism in FIG. 1.

FIGS. 3(A)-3(B) are cross-sectional views of a wax-type thermostat provided in the circuit switching mechanism of FIG. 1, where FIG. 3(A) shows an operation state at a low temperature and FIG. 3(B) shows an operation state at a high temperature.

FIG. 4 is a graph showing temperature rise of coolant in a cooling control device of the internal combustion engine according to one or more embodiments of the present invention.

FIG. 5 is a cooling circuit diagram of the internal combustion engine in another example according to one or more embodiments of the present invention.

FIG. 6 is a cross-sectional view of the circuit switching mechanism used in the cooling circuit of FIG. 5.

FIGS. 7(A)-7(C) include cross-sectional views each showing an operation state of the wax-type thermostat provided in the circuit switching mechanism of FIG. 6, where FIG. 7(A) shows a state before open operation, FIG. 7(B) shows a state where the open operation is started, and FIG. 7(C) shows an open operation state.

DETAILED DESCRIPTION

Embodiments of the present invention are described below in detail with reference to drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

FIG. 1 shows a cooling circuit diagram of an internal combustion engine. For example, an internal coolant passage 4 in which coolant circulates through a cylinder block 2 and cylinder heads 3 is formed in the internal combustion engine 1 of a car engine or the like. Multiple external coolant passages are connected to the internal coolant passage 4. The external coolant passages includes a radiator circuit 6 (6A, 6B) running through a radiator 5 which is a heat exchanger, a heater circuit 8 (8A, 8B) running through a heater core 7, and a bypass circuit 10 (10A, 10B) running through a water pump 9. For example, water is used as the coolant.

The radiator circuit 6 includes a radiator circuit 6A connecting the radiator 5 and a circuit switching mechanism 11 as well as the radiator circuit 6B connecting the radiator 5 and the water pump 9, the circuit switching mechanism 11 being a circuit switching means connected to an outlet 4A of the internal coolant passage 4. The radiator circuit 6 sends the coolant heated in the internal coolant passage 4 formed in the internal combustion engine 1 to the radiator 5 and the heated coolant is cooled in the radiator 5 by performing heat exchange with air. Then, the radiator circuit 6 returns the cooled coolant to the internal coolant passage 4.

The heater circuit 8 includes a heater circuit 8A connecting the circuit switching mechanism 11 and the heater core 7 as well as a heater circuit 8B connecting the heater core 7 and the water pump 9. The heater circuit 8 causes the coolant heated in the internal coolant passage 4 formed in the internal combustion engine 1 to disperse heat in the heater core 7 and then returns the coolant after the heat dispersion to the internal coolant passage 4.

The bypass circuit 10 includes a bypass circuit 10A connecting the circuit switching mechanism 11 and a water pump 9 as well as a bypass circuit 10B connecting the water pump 9 and the internal coolant passage 4. The bypass circuit 10 returns the coolant in the internal coolant passage 4 formed in the internal combustion engine 1 to the internal coolant passage 4 without causing the coolant to flow through the radiator circuit 6.

FIG. 2 shows a cross-sectional view of a main portion of the circuit switching mechanism 11. The circuit switching mechanism 11 includes a body 12 in which flow passages connected respectively to the internal coolant passage 4, the radiator circuit 6, the heater circuit 8, and the bypass circuit 10 are formed. A radiator hose connection port 13 for connection with the radiator circuit 6, a heater hose connection port 14 for connection with the heater circuit 8, and a bypass hose connection port 15 for connection with the bypass circuit 10 are provided on side surfaces of the body 12.

The body 12 is provided therein with a circuit switching means 16 for switching the circuits by connecting or disconnecting the internal coolant passage 4 to or from each of the radiator circuit 6, the heater circuit 8, and the bypass circuit 10 to cause the coolant flowing into the body from the outlet 4A of the internal coolant passage 4 to flow to one of the circuits as needed. In FIG. 2, the circuit switching means 16 is schematically illustrated.

Moreover, the body 12 is provided therein with a branching passage 28 which is a flow passage separate from the flow passage which causes the coolant flowing in from a coolant introduction port 29 formed in a body lower portion and connected to the outlet 4A of the internal coolant passage 4 to flow to the radiator hose connection port 13. The branching passage 28 is configured such that the coolant introduced from the coolant introduction port 29 in the body lower portion flows to the radiator hose connection port 13 without passing through the circuit switching means 16.

The branching passage 28 is provided with a wax-type thermostat 30 which opens the branching passage 28 when the internal combustion engine 1 is excessively heated. As shown in FIGS. 3(A)-3(B), in the wax-type thermostat 30, when wax 32 encapsulated in a metal container 31 is heated, the wax 32 changes from the solid phase to the liquid phase and the volume thereof increases, thereby pushing a piston 33 upward. Moreover, in the wax-type thermostat 30, when the wax 32 is cooled and changes from the liquid phase to the solid phase, the volume thereof decreases and this causes the piston 33 to retreat into the metal container 31 and return to its original state.

In the wax-type thermostat 30, a front end portion of the piston 33 is fixed to an inner wall surface of the radiator hose connection port 13. Here, the piston 33 has a shape not blocking the flow of the coolant flowing from the circuit switching means 16 to the radiator hose connection port 13. Moreover, a sealing portion 34 provided at a front end of the metal container 31 has a shape blocking an outlet of the branching passage 28 at a normal temperature. In the wax-type thermostat 30, when the temperature of the coolant flowing in the internal coolant passage 4 becomes high due to the excessive heating of the internal combustion engine 1, the wax 32 changes from the solid phase to the liquid phase by the heat of the high-temperature coolant, and the piston 33 protrudes from the metal container 31. This causes the sealing portion 34 to move away from the outlet of the branching passage 28 and the branching passage 28 thereby opened.

In the wax-type thermostat 30, when the excessive heating state of the internal combustion engine 1 is resolved and the coolant flowing in the internal coolant passage 4 is in a state of the normal temperature which is a low temperature, the wax 32 changes from the liquid phase to the solid phase due to the heat of the low-temperature coolant and the piston 33 retreats into the metal container 31. This causes the sealing portion 34 to block the outlet of the branching passage 28 and the branching passage 28 is thereby closed.

The operation temperature of the wax-type thermostat 30 is higher than a circuit switching temperature at which the circuit switching means 16 performs circuit switching and is lower than a temperature at which the internal combustion engine 1 overheats.

In a normal cooling control device, when the circuit switching means 16 fails for some reason with the radiator circuit 6, the heater circuit 8, and the bypass circuit 10 closed, the temperature of the coolant flowing through the internal coolant passage 4 formed in the internal combustion engine 1 becomes excessively high and this leads to overheating.

However, in one or more embodiments of the present invention, the wax-type thermostat 30 operates to open the branching passage 28 before the coolant temperature in the internal coolant passage 4 reaches a high temperature of overheating. This causes the coolant in the internal coolant passage 4 to flow to the radiator circuit 6 via the branching passage 28. As a result, the overheating of the internal combustion engine 1 can be prevented.

Moreover, no complex mechanism such as a clutch mechanism is used in one or more embodiments of the present invention. Instead, there is used the wax-type thermostat 30 which operates by utilizing the volume change of the wax 32 in the phase change from the solid phase to the liquid phase and vice versa due to the heat of the coolant flowing in the internal coolant passage 4. Accordingly, no complex control mechanism or operation mechanism for operation is necessary. Hence, an increase in cost due to an increase in the number of parts constituting the device can be avoided and, in addition, the reliability can be improved.

In one or more embodiments of the present invention, the operation temperature of the wax-type thermostat 30 is set to be a temperature higher than the circuit switching temperature at which the circuit switching is performed by the work of the circuit switching means 16. Accordingly, the wax-type thermostat 30 works to open the branching passage 28 only when an abnormality is detected. Hence, a fail-safe function can be provided without a warming-up performance of the internal combustion engine 1 being impaired.

Moreover, in the cooling control method according to one or more embodiments of the present invention, when the failure of the circuit switching means 16 causes the radiator circuit 6 and the internal coolant passage 4 to be disconnected from each other and the internal combustion engine 1 is excessively heated, the wax-type thermostat 30 provided in the branching passage 28 for sending the coolant in the internal coolant passage 4 to the radiator circuit 6 and the radiator 5 works to open the branching passage 28 and cause the coolant flowing in the internal coolant passage 4 to flow to the radiator circuit 6. Accordingly, the overheating of the internal combustion engine 1 can be prevented.

Moreover, in one or more embodiments of the present invention, the radiator circuit 6, the heater circuit 8, and the bypass circuit 10 are all closed in the start of the internal combustion engine 1. This can reduce the warm-up time because the flow of the coolant in the internal coolant passage 4 can be set to zero. FIG. 4 is a graph showing temperature rise states of the coolant with respect to elapsed time in one or more embodiments of the present invention and the related art. The line A in FIG. 4 shows a temperature rise line of the coolant in one or more embodiments of the present invention and the line B shows a temperature rise line of the coolant in the related art. In the related art, since the water pump 9 rotates to cause the coolant to circulate through the internal combustion engine 1, the heater circuit 8, and the bypass circuit 10, the heat capacity is large and a long time is required for the warm up. However, in one or more embodiments of the present invention, since the heat generated in the internal combustion engine 1 is used only to raise the temperature of the coolant in the internal combustion engine 1, the warm-up time can be drastically reduced compared to that of the related art.

After the internal combustion engine 1 is sufficiently warmed up, the excessive heating of the internal combustion engine 1 can be prevented by opening the heater circuit 8 or the bypass circuit 10 to cause the coolant to circulate. When the temperature of the coolant further rises, the radiator circuit 6 is opened to disperse the heat by using the radiator 5. The temperature of the coolant flowing in the internal coolant passage 4 of the internal combustion engine 1 is controlled by adjusting the opening ratio of the radiator circuit 6. The normal temperature of the coolant of the internal combustion engine 1 is controlled to be around 90 degree Celsius. However, the temperature of the coolant can be raised to, for example, 100 degree Celsius to raise the temperature of the engine. This causes the friction to be reduced and the fuel efficiency can be thereby improved.

FIG. 5 is a cooling circuit diagram of an internal combustion engine according to one or more embodiments of the present invention. FIG. 6 is a cross-sectional view of a circuit switching mechanism used in the cooling circuit of FIG. 5. FIGS. 7(A)-7(C) include cross-sectional views each showing an operation state of a wax-type thermostat provided in the circuit switching mechanism of FIG. 6. In one or more embodiments of the present invention, the structure is such that a temperature sensing portion of the wax-type thermostat 30 is provided near an inlet of, among the external coolant passages, an external coolant passage (throttle circuit) configured to send the coolant in the internal coolant passage 4 to a throttle chamber 37.

Specifically, a throttle circuit 38 for causing the coolant flowing in the internal coolant passage 4 to constantly flow to the throttle chamber 37 is provided. The throttle circuit 38 includes a throttle circuit 38A connecting the coolant introduction port 29 and the throttle chamber 37 as well as a throttle circuit 38B connecting the throttle chamber 37 and the radiator circuit 6B, the coolant introduction port 29 formed in the lower portion of the body 12. The temperature sensing portion of the wax-type thermostat 30 is provided near the inlet of the throttle circuit 38A through which the coolant flows from the outlet 4A of the internal coolant passage 4 to the throttle chamber 37 via the coolant introduction port 29. Accordingly, the coolant considered to be at the same temperature as that at the outlet 4A of the internal coolant passage 4 flows to the temperature sensing portion of the wax-type thermostat 30.

For example, when the failure of the circuit switching means 16 causes the radiator circuit 6 and the internal coolant passage 4 to be disconnected from each other and the internal combustion engine 1 is excessively heated, the wax-type thermostat 30 arranged in the middle of the flow passage through which the coolant flows from the outlet port 4A of the internal coolant passage 4 to the throttle chamber 37 via the coolant introduction port 29 detects the temperature of the coolant and opens the branching passage 28 to cause the coolant flowing in the internal coolant passage 4 to flow to the radiator circuit 6. Accordingly, the overheating of the internal combustion engine 1 can be prevented.

The wax-type thermostat 30 is set to a state where the branching passage 28 is closed as shown in FIG. 7(A), at the normal temperature. Meanwhile, when the internal combustion engine 1 is excessively heated and the coolant temperature in the internal coolant passage 4 becomes close to the temperature of overheating, the branching passage 28 is opened as shown in FIGS. 7 (B) and (C).

In one or more embodiments of the present invention, since the temperature sensing portion of the wax-type thermostat 30 is arranged near the inlet of the throttle circuit 38A through which the coolant in the internal coolant passage 4 constantly flows to the throttle chamber 37, the temperature of the excessively-heated coolant flowing through the internal coolant passage 4 of the internal combustion engine 1 is immediately detected and the branching passage 28 is opened. Accordingly, it is possible to quickly send the coolant to the radiator 5 when the internal combustion engine 1 is excessively heated and thereby prevent the overheating of the internal combustion engine 1. In one or more embodiments of the present invention, as described above, the excessively-heated coolant flowing out from the outlet 4A of the internal coolant passage 4 reaches the temperature sensing portion of the wax-type thermostat 30 not by the natural convection. Accordingly, when the internal combustion engine 1 is excessively heated, the wax-type thermostat 30 works immediately and the overheating of the internal combustion engine 1 can be thus prevented.

Embodiments of the present invention have been described above. However, the present invention is not limited to this.

One or more embodiments of the present invention can be used in a cooling control device of an internal combustion engine such as a car engine.

In the cooling control device for an internal combustion engine according to one or more embodiments of the present invention, when the internal combustion engine is excessively heated due to the failure of the circuit switching means, the branching passage is opened not by a mechanical mechanism such as one which opens a valve by controlling a clutch mechanism with a control circuit, but by the operation of the wax-type thermostat which works at a certain coolant temperature. The high-temperature coolant in the internal coolant passage of the internal combustion engine thus flows to the external coolant passage passing through the radiator. Accordingly, one or more embodiments of the present invention can prevent the overheating of the internal combustion engine even when the circuit switching means fails. Moreover, since one or more embodiments of the present invention uses no complex mechanisms such as a clutch mechanism, the increase in cost due to the increase in the number of parts constituting the device can be avoided.

In one or more embodiments of the present invention, the temperature sensing portion of the wax-type thermostat is arranged near the inlet of the external coolant passage through which the coolant in the internal coolant passage constantly flows to the throttle chamber. Accordingly, it is possible to immediately detect the temperature of the excessively-heated coolant flowing in the internal coolant passage of the internal combustion engine and open the branching passage. Hence, when the internal combustion engine is excessively heated, it is possible to quickly send the coolant to the radiator and prevent the overheating of the internal combustion engine.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

1 internal combustion engine
4 internal coolant passage
5 radiator
6, 6A, 6B radiator circuit
7 heater core
8, 8A, 8B heater circuit
9 water pump
10, 10A, 10B bypass circuit
11 circuit switching mechanism
16 circuit switching means
28 branching passage
29 coolant introduction port
30 wax-type thermostat
37 throttle chamber

The invention claimed is:

1. A cooling control device for an internal combustion engine comprising:

an internal coolant passage formed in the internal combustion engine;

a plurality of external coolant passages formed outside the internal combustion engine;

a control valve that switches a coolant passage circuit by disconnecting one of the external coolant passages connected to the internal coolant passage from the internal coolant passage, and by connecting another of the external coolant passages to the internal coolant passage;

a branching passage that sends coolant in the internal coolant passage to one of the external coolant passages coupled to a radiator, when the one of the external coolant passages coupled to the radiator is disconnected from the internal coolant passage as a result of control valve failure; and a wax-type thermostat provided in the branching passage that opens the branching passage when the internal combustion engine is excessively heated, wherein the wax-type thermostat comprises a container encapsulating wax, wherein the container is provided at an inlet of a throttle circuit that constantly sends the coolant in the internal coolant passage to a throttle chamber, and wherein the container is arranged in a middle of a flow passage through which the coolant flows from the internal coolant passage to the throttle chamber.

2. The cooling control device for the internal combustion engine according to claim 1, wherein an operation temperature of the wax-type thermostat is higher than a circuit switching temperature of the control valve.

3. A cooling control method for an internal combustion engine having an internal coolant passage formed in the internal combustion engine; and a plurality of external coolant passages formed outside the internal combustion engine;

the cooling control method comprising:

switching a coolant passage circuit by disconnecting one of the external coolant passages connected to the internal coolant passage from the internal coolant passage, and by connecting another of the external coolant passages to the internal coolant passage; and opening, via a wax-type thermostat, a branching passage, and causing coolant in the internal coolant passage to flow to the external coolant passage communicating with a radiator, when the external coolant passage communicating with the radiator and the internal coolant passage are disconnected from each other due to failure of a switching circuit and the internal combustion engine is excessively heated, wherein the branching passage sends the coolant in the internal coolant passage to the radiator through the external coolant passage communicating with the radiator, wherein the wax-type thermostat comprises a container encapsulating wax, and wherein the container is provided at an inlet of a throttle circuit that constantly sends the coolant in the internal coolant passage to a throttle chamber, and wherein the container is arranged in a middle of a flow passage through which the coolant flows from the internal coolant passage to the throttle chamber.

* * * * *